US009201332B2

(12) United States Patent
Sabu et al.

(10) Patent No.: US 9,201,332 B2
(45) Date of Patent: Dec. 1, 2015

(54) CHARGER, ION GENERATOR, IMAGE FORMING APPARATUS, AND PROCESS CARTRIDGE

(71) Applicants: Satomi Sabu, Shizuoka (JP); Shinji Ohtani, Shizuoka (JP)

(72) Inventors: Satomi Sabu, Shizuoka (JP); Shinji Ohtani, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/322,019

(22) Filed: Jul. 2, 2014

(65) Prior Publication Data

US 2015/0016842 A1 Jan. 15, 2015

(30) Foreign Application Priority Data

Jul. 12, 2013 (JP) ..... 2013-146534

(51) Int. Cl.

| | |
|---|---|
| ***G03G 15/02*** | (2006.01) |
| ***G03G 21/18*** | (2006.01) |
| ***H01T 19/00*** | (2006.01) |
| ***H01J 3/02*** | (2006.01) |

(52) U.S. Cl.

CPC ..... *G03G 15/02* (2013.01); *H01J 3/021* (2013.01); *H01T 19/00* (2013.01); *G03G 15/0291* (2013.01); *G03G 21/18* (2013.01)

(58) Field of Classification Search

CPC ..... G03G 15/0233; G03G 15/025; G03G 21/1814; H01T 19/00; H01J 1/3048; H01J 1/3044; H01J 1/32; H01J 2329/041; H01J 2329/0413; H01J 2329/0415; H01J 2329/0431; H01J 2329/0439; H01J 2329/0442; H01J 2329/0473; H01J 2329/0471

See application file for complete search history.

(56) References Cited

U.S. PATENT DOCUMENTS

2007/0231010 A1* 10/2007 Ohta et al. ..... 399/168

FOREIGN PATENT DOCUMENTS

| | | |
|---|---|---|
| JP | 56-104351 | 8/1981 |
| JP | 57-178257 | 11/1982 |
| JP | 58-040566 | 3/1983 |
| JP | 58-139156 | 8/1983 |
| JP | 58-150975 | 9/1983 |
| JP | 63-149669 | 6/1988 |
| JP | 8-106200 | 4/1996 |
| JP | 2000-199469 | 7/2000 |
| JP | 2001-189199 | 7/2001 |
| JP | 2001-250467 | 9/2001 |
| JP | 2002-279885 | 9/2002 |
| JP | 2002-311684 | 10/2002 |

(Continued)

OTHER PUBLICATIONS

Non-patent document 1: Shinji Ohtani, et al. The draft of the 31-st electroceramics workshop, 2P01, published in Oct. 2011 (English translation).

(Continued)

*Primary Examiner* — Clayton E Laballe
*Assistant Examiner* — Victor Verbitsky
(74) *Attorney, Agent, or Firm* — Cooper & Dunham LLP

(57) ABSTRACT

A charger to apply a charge to an object is provided. The charger includes an electron emitter including an electroconductive substrate; and a layer of n-type hexagonal boron nitride codoped with magnesium and oxygen atoms, which is located on the electroconductive substrate, wherein the concentration of oxygen atoms in the layer of n-type hexagonal boron nitride codoped with magnesium and oxygen atoms is higher than the concentration of magnesium atoms in the layer.

14 Claims, 6 Drawing Sheets

(56) References Cited

FOREIGN PATENT DOCUMENTS

| | | |
|---|---|---|
| JP | 2003-140444 | 5/2003 |
| JP | 2003-145826 | 5/2003 |
| JP | 2004-327084 | 11/2004 |
| JP | 2006-179321 | 7/2006 |
| JP | 2006-323386 | 11/2006 |

OTHER PUBLICATIONS

Non-patent document 2: Shinji Ohtani et al. International Conference on Electronic and Materials (ICEM) 2012 Abstract (Aug. 2012).
Non-patent document 3: S. Ohtani et al. International Union of Materials Research Societys-International Conference in Asia (IUMRS-ICA) 2012 (Aug. 2012).

* cited by examiner

CHARGER, ION GENERATOR, IMAGE FORMING APPARATUS, AND PROCESS CARTRIDGE

CROSS-REFERENCE TO RELATED APPLICATIONS

This patent application is based on and claims priority pursuant to 35 U.S.C. §119 to Japanese Patent Applications Nos. 2013-146534 filed on Jul. 12, 2013, and 2014-093415 filed on Apr. 30, 2014, in the Japan Patent Office, the entire disclosure of which is hereby incorporated by reference herein.

BACKGROUND

1. Technical Field

This disclosure relates to a charger to apply a charge to an object using an electron emitting element. In addition, this disclosure relates to an image forming apparatus and a process cartridge using the charger. Further, this disclosure relates to an ion generator to generate a positive ion and a negative ion by bombarding a water molecule in the air with an electron emitted by an electron emitter to which a voltage is applied.

2. Description of the Related Art

Initially, the background art of charger, image forming apparatus and process cartridge will be described.

Electrophotographic image forming apparatus have been used for image forming apparatus such as printers, facsimiles, copiers, plotters and multi-functional products having two or more of the printing, facsimileing, and copying functions. In such electrophotographic image forming apparatus, corona chargers and short-range chargers, which utilize a discharge phenomenon, have been broadly used for a charger, which charges an image carrier to form a latent image on the image carrier.

Corona chargers typically include a metal wire with a diameter of from 40 μm to 200 μm and a grounded metal casing arranged around the metal wire, and a high AC voltage or a high DC voltage is applied to the wire and the casing to cause corona discharging, thereby charging an image carrier. Corona chargers are broadly classified into corotron chargers having a wire and a casing, and scorotron chargers having a wire, a casing and a grid electrode which has a net-like structure and which is formed in an opening of the casing. In addition, corona chargers which use a thin electrode having a sawtooth shape instead of a wire have also been used.

In contrast, short-range chargers have a configuration such that a charging member is contacted with an image carrier or is arranged so as to be close to an image carrier with a small gap therebetween, and a high DC voltage or a high AC voltage is applied to the charging member and the image carrier to cause discharging, thereby charging the image carrier. A roller is typically used as the charging member.

These corona chargers and short-range chargers accelerate electrons or positive or negative ions in the air by an electric field formed thereby so that the electrons or ions collide with neutral particles in the air, resulting in formation of ions or electrons, thereby charging an image carrier. When these chargers are used and the electrons formed by the discharging are collided with oxygen molecules and nitrogen molecules in the air, discharge products such as ozone ($O_3$) or nitrogen oxides (NOx) are generated. As mentioned below, ozone and nitrogen oxides cause various problems.

Specifically, ozone has a very strong oxidizing power, and therefore ozone is used for water treatment, removal of bad odor, decolorization, removal of organic materials, and sterilization. However, ozone is harmful for human body because of irritating mucous membranes of nose and throat when the concentration of ozone is not less than a certain value. Therefore, there are various restrictions on ozone. For example, there is a regulation, the Blue Angel (Germany), concerning printers and copiers, and the amount of ozone exhausted by such an apparatus in an office is restricted to 3 mg/h or less.

In addition, ozone oxidizes the surface of a photoreceptor serving as an image carrier, thereby deteriorating the photosensitivity and the charging property of the photoreceptor, resulting in deterioration of quality of images formed by the photoreceptor. In addition, since ozone has a strong oxidizing power, ozone deteriorates rubber, plastic and metallic parts of image forming apparatus as well as photoreceptors.

Nitrogen oxides react with moisture in the air to produce nitric acid, and react with a metal to produce a metal nitrate. These products have a high electric resistance under low humidity conditions, but have a low electric resistance under high humidity conditions because of reacting with moisture in the air. When a layer of nitric acid or a metal nitrate is formed on the surface of a photoreceptor, abnormal images (blurred images) are formed. This is because nitric acid or the metal nitrate on the photoreceptor absorbs moisture in the air and has a low electric resistance, and thereby the electrostatic latent image formed on the photoreceptor is degraded.

In addition, since nitrogen oxides stay in the air after discharge without being decomposed, adhesion of compounds generated by the nitrogen oxides to the surface of a photoreceptor is caused even at a time (i.e., down-time of the apparatus) in which charging of the photoreceptor is not performed. Such compounds penetrate into the photoreceptor with time, and deteriorate the photoreceptor. In this regard, in order to remove such compounds from the surface of the photoreceptor, a method in which the surface of the photoreceptor is shaved slightly in a cleaning operation has been used. However, this method causes other problems such that the running cost increases, and the photoreceptor is deteriorated with time by the shaving.

Further, such compounds also deteriorate the insulating property of an end block of a corona charger.

Among various chargers, corona chargers generate a greatest amount of ozone. Specifically, scorotron chargers generate ozone in an extremely large amount of from 8 to 20 ppm, and therefore an ozone filter is necessary for image forming apparatus to prevent ozone from being discharged from the apparatus. In contrast, short-range chargers typically generate ozone in an amount of 0.01 ppm when only a DC voltage is applied thereto for 4 hours while producing ozone in an amount of from 0.3 to 0.4 ppm when a DC voltage on which an AC voltage is superimposed is applied thereto. In short-range chargers applying an AC voltage-superimposed DC voltage, positive discharge and reverse discharge are repeatedly caused, and thereby the photoreceptor can be evenly charged. However, due to the repeated discharge, the amount of ozone generated is relatively large, and therefore an ozone filter may be necessary.

As mentioned above, the amount of ozone depends on the chargers, and there are chargers which generate a relatively small amount of ozone. However, in order to fulfill various requirements such as evenness of charging and charging speed, chargers generating a relatively large amount of ozone have to be used at the present time. For example, corona chargers, which produce a relatively large amount of ozone but have good charging ability, are used for high speed image forming apparatus.

Recently, instead of these chargers, chargers using an electron emitter have attracted attention.

For example, JP-2003-145826-A discloses a charger using a so-called MIS (Metal Insulator Semiconductor) or MIM (Metal Insulator Metal) type electron emitter, in which an electron emitting layer constituted of a combination of an insulator layer and a semiconductor layer or a combination of an insulator layer and a metal layer is sandwiched by a substrate electrode and a film electrode.

JP-3878388-B1 (i.e., JP-2001-250467-A) discloses a charger using an electron emitter, which includes, as a constituent, a carbon nanotube whose tip portion is covered with (a) a metal or a metal alloy or (b) at least one of a nitride, carbide, silicate or borate including a metal.

JP-4823429-B1 (i.e., JP-2002-279885-A) discloses a charger using an electron emitter, which includes a substrate constituted of a material such as quartz, glass, ceramics, metals and silicon (e.g., silicon substrates); an emitter electrode formed on one surface of the substrate by forming a layer of a metal or a metal alloy; plural anodized layers which are formed on the electrode at regular intervals by anodizing plural aluminum layers, which are formed on the emitter electrode at regular intervals, in an acid such as sulfuric acid and perchloric acid; fine pores, which are formed at a location between two adjacent anodized layers and have openings on a side of the substrate opposite to the side bearing the emitter electrode; carbon nanotubes, which are arranged in the fine pores in such a manner that the bottom surfaces thereof are contacted with the emitter electrode and which emit electrons by field emission; and an extraction electrode covering the openings of the fine pores, wherein the carbon nanotubes are surrounded by the emitter electrode, the anodized layers, and the extraction electrode.

JP-4216112-B1 (i.e., JP-2004-327084-A) discloses a charger using an electron emitter, which includes an upper electrode, a lower electrode, and a semiconductor layer formed between the upper and lower electrodes, wherein an organic compound layer is formed on the surface of the semiconductor layer by adsorption.

In addition, JP-4571331-B1 (i.e., JP-2002-311684-A) and JP-2003-140444-A have disclosed chargers using an electron emitter.

Further, JP-4877749-B1 (JP-2006-323366-A) discloses a charger using an electron emitter which is formed by using a $sp^3$ bonded 5H-boron nitride (BN) material or a $sp^3$ bonded 6H-boron nitride (BN) material.

Next, the background art of ion generator will be described.

There are ion generators having a needle electrode and a counter electrode. In these ion generators having a needle discharge electrode and a counter electrode, a high DC voltage or a high AC voltage is applied to the discharge electrode to ionize the air in the vicinity of the discharge electrode by corona discharge. Various improvements have been performed on such ion generators to enhance the air ionization efficiency, to stably perform ionization, to control the ratio of positive ions to negative ions, to reduce the amount of ozone generated, and to reduce electromagnetic radiation noise.

One of the problems to be solved, i.e., reduction of the amount of ozone generated, will be described. Ion generators utilizing a discharge phenomenon generate ozone when generating a positive ion $H^+(H_2O)m$ and a negative ion $O_2^-(H_2O)n$. Since ozone has a strong oxidizing power, ozone is used for water treatment, removal of bad odor, decolorization, removal of organic materials, and sterilization. However, ozone has a bad odor, and is harmful for human body because of irritating mucous membranes of nose and throat when the concentration of ozone is not less than a certain value.

The electromagnetic radiation noise, which is another problem to be solved, causes problems such as electrostatic discharge failure or characteristic degradation of an electronic device present in the vicinity of the ion generator, and glitch of electronic systems.

In attempting to solve these problems, JP-2001-189199-A discloses an ion generator which includes a needle discharge electrode and an electroconductive counter electrode, wherein a high AC voltage is applied to the discharge electrode to ionize the air in the vicinity of the discharge electrode by corona discharge. In this ion generator, the tip of the discharge electrode is constituted of a silicon single crystal, the shortest distance (L) between the tip of the discharge electrode and the counter electrode is from 0.4 cm to 4 cm, and the effective voltage (V) of the AC voltage applied to the discharge electrode is not greater than 8 kV while satisfying the following relationship:

$$1.8\ L(\text{cm})+0.5<V(\text{kV})<2.8\ L(\text{cm})+1.0.$$

It is described therein that when the effective voltage (V) of the AC voltage applied to the discharge electrode is not greater than 8 kV while satisfying the above-mentioned relationship, the amount of ozone generated can be controlled so as to be not greater than about 10 volppb, and the electromagnetic radiation noise can be controlled so as to be slightly greater than the background noise level (i.e., white noise level) of from 2 to 5 mV.

JP-4677629-B1 (i.e., JP-2006-179321-A) discloses an electron emitter which is prepared by a method in which boron nitride is deposited on a substrate from a vapor phase while irradiating boron nitride on the substrate with high energy ultraviolet rays to form a layer of boron nitride on the substrate. It is described therein that the layer has projections having a sharp tip, which are $sp^3$ bonded boron nitride and which are formed on the substrate at regular intervals in a self-organization manner while extending in the direction parallel to the light irradiation direction. In addition, it is described therein that the density of the projections depends on the direction of the reaction mixture gas used for forming the layer.

SUMMARY

As an aspect of this disclosure, a charger to apply a charge to an object (such as an image carrier (e.g., a photoreceptor and a transfer belt for use in image forming apparatus)) is provided which includes an electron emitter including an electroconductive substrate, and a layer of n-type hexagonal boron nitride codoped with magnesium (Mg) and oxygen (O) atoms, which is located on the electroconductive substrate. In this regard, the concentration of oxygen atoms in the layer of n-type hexagonal boron nitride codoped with magnesium and oxygen atoms is higher than the concentration of magnesium atoms in the layer.

As another aspect of this disclosure, a process cartridge is provided which includes the above-mentioned charger to charge an image carrier to form an electrostatic latent image on a surface of the image carrier, and at least one of the image carrier, a developing device to visualize the electrostatic latent image using a colored material, and a cleaner to clean the surface of the image carrier. The charger and at least one of the image carrier, the developing device, and the cleaner are integrated as a single unit so as to be detachably attachable to an image forming apparatus.

As another aspect of this disclosure, an image forming apparatus is provided which includes an image carrier to bear an electrostatic latent image on a surface thereof, the above-mentioned charger to charge the image carrier to form the electrostatic latent image, and a developing device to visualize the electrostatic latent image using a colored material.

Alternatively, the image forming apparatus may be a color image forming apparatus including two or more of the above-mentioned process cartridge, and produces images having different color tones using two or more of the process cartridge.

As another aspect of this disclosure, an ion generator to generate an ion by bombarding a water molecule in the air with an electron is provided which includes an electron emitter including an electroconductive substrate, and a layer of n-type hexagonal boron nitride codoped with magnesium (Mg) and oxygen (O) atoms, which is located on the electroconductive substrate. The concentration of oxygen atoms in the layer of n-type hexagonal boron nitride codoped with magnesium and oxygen atoms is higher than the concentration of magnesium atoms in the layer.

The aforementioned and other aspects, features and advantages will become apparent upon consideration of the following description of the preferred embodiments taken in conjunction with the accompanying drawings.

DETAILED DESCRIPTION

Figure 1:
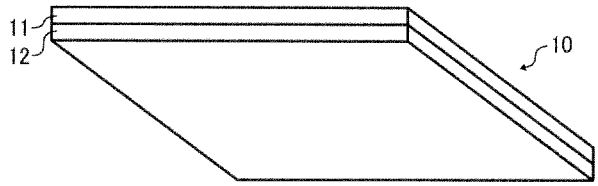
FIG. 1 is a schematic view illustrating a thin-layer type electron emitter for use in a charger according to an embodiment.

Among the above-mentioned chargers using an electron emitter, investigation of carbon nano-materials has been actively made recently, and among the carbon nano-materials, investigation of carbon nanotube has been broadly made. In this regard, it is said that electron emitters using carbon nanotube have a high electron emitting ability. For example, it is described in JP-3878388-B1 (i.e., JP-2001-250467-A) mentioned above that the electron emitter using carbon nanotube whose tip is covered with a specific material has good durability, and the electron emitter can be used as a non-contact charger and a contact charger.

However, since carbon nanotube is an organic material, carbon nanotube is oxidized by an oxygen atom excited by electrons emitted by the carbon nanotube in the air in electrophotography, followed by decomposition due to burning thereof. Thus, carbon nanotube has a problem to be solved such that carbon nanotube is very weak in structure, and therefore the life of the charger using carbon nanotube is shorter than the desired life of charger for use in electrophotography.

In addition, the charger described in JP-2003-145826-A mentioned above, which uses an electron emitter having the MIS or MIM structure, can produce the electron acceleration effect due to large potential gradient, but cannot produce the electric field enhancing effect because the tip of the electron emitter is not sharp, and is the flat surface of a thin flat film electrode. Namely, the electron emitter has an insufficient electron emitting ability.

The electron emitter described in JP-4877749-B1 (JP-2006-323366-A), which uses a $sp^3$ bonded 5H-boron nitride (BN) material or a $sp^3$ bonded 6H-boron nitride (BN) material, has a number of micro-corn emitters which are formed on a thin layer of the material and which have a sharp spindle form with a size of about 10 μm, and therefore the electron emitter can have high electron emitting ability. However, it is hard to form micro-corn emitters having uniform density, size and shape, and therefore the properties of the electron emitter tend to vary.

The technology described in JP-4677629-B1 (i.e., JP-2006-179321-A) mentioned above does not relate to a technology in which a layer of n-type hexagonal boron nitride is formed by codoping hexagonal boron nitride with an oxygen atom serving as a donor and a magnesium atom serving as an acceptor. In addition, in the technology the $sp^3$ bonded boron nitride having a sharp tip is formed in a self-organization manner, and is not formed by using a pillar type substrate. Further, the technology of JP-4677629-B1 (i.e., JP-2006-179321-A) does not relate to electrophotography, and relates to another technical field, i.e., an electron emitter for use in a field emission type display.

With respect to ion generator, conventional ion generators generate an ion utilizing corona discharge, and therefore the applied voltage is large and a large-size power source is necessary. Therefore, it is difficult to provide a small-size ion generator. In addition, since conventional ion generators are driven by a high voltage, problems such that electromagnetic radiation noise and ozone are generated are caused.

The object of this disclosure is to solve the problems mentioned above, and is to provide a charger which can stably emit electrons with hardly generating discharge products not to cause hazard to an object to be charged (such as an image carrier (e.g., a photoreceptor and a transfer belt for use in image forming apparatus)) and which uses an electron emitter having good resistance to deterioration, and a process cartridge and an image forming apparatus using the charger.

The charger of this disclosure includes an electron emitter including an electroconductive substrate, and a layer of n-type hexagonal boron nitride codoped with magnesium (Mg) and oxygen (O) atoms, which is located on the electroconductive substrate (this electron emitter is hereinafter referred to as a thin-layer type electron emitter). In this regard, the concentration of oxygen atoms in the layer of n-type hexagonal boron nitride codoped with magnesium and oxygen atoms is higher than the concentration of magnesium atoms in the layer. The electron emitter may be a pillar type electron emitter having a configuration such that the electroconductive substrate has projections on a surface thereof, and the layer of n-type hexagonal boron nitride codoped with magnesium (Mg) and oxygen (O) atoms is located on the surface of the electroconductive substrate while having projections. Further, the electron emitter may be a gate electrode type electron emitter having a configuration such that the electroconductive substrate has projections on a surface thereof, and the layer of n-type hexagonal boron nitride codoped with magnesium (Mg) and oxygen (O) atoms is located on the surface of the electroconductive substrate while having projections, wherein the electron emitter further includes an insulator layer located on the surface of the layer of n-type hexagonal boron nitride codoped with magnesium (Mg) and oxygen (O) atoms in such a manner as to surround the projections of the layer of n-type hexagonal boron nitride codoped with magnesium (Mg) and oxygen (O) atoms, and a gate electrode located on the insulator layer.

The process cartridge of this disclosure includes the above-mentioned charger to charge an image carrier to form an electrostatic latent image on a surface of the image carrier, and at least one of the image carrier, a developing device to visualize the electrostatic latent image using a colored material, and a cleaner to clean the surface of the image carrier. The charger and at least one of the image carrier, the developing device, and the cleaner are integrated as a single unit so as to be detachably attachable to an image forming apparatus.

The image forming apparatus of this disclosure includes an image carrier to bear an electrostatic latent image on a surface thereof, the above-mentioned charger to charge the image carrier to form the electrostatic latent image, and a developing device to visualize the electrostatic latent image using a colored material.

Alternatively, the image forming apparatus may be a color image forming apparatus including two or more of the above-mentioned process cartridge, and produces images having different color tones using two or more of the process cartridge.

The ion generator of this disclosure generates an ion by bombarding a water molecule in the air with an electron, and includes an electron emitter including an electroconductive substrate, and a layer of n-type hexagonal boron nitride codoped with magnesium (Mg) and oxygen (O) atoms, which is located on the electroconductive substrate. The concentration of oxygen atoms in the layer of n-type hexagonal boron nitride codoped with magnesium and oxygen atoms is higher than the concentration of magnesium atoms in the layer. The electron emitter may be the pillar type electron emitter or the gate electrode type electron emitter mentioned above.

It will be understood from the below description that the process cartridge and the image forming apparatus of this disclosure, which uses the charger of this disclosure, can stably emit electrons with hardly generating discharge products not to cause hazard to an object (such as an image carrier (e.g., a photoreceptor and a transfer belt)) and which hardly deteriorates the electron emitter. In addition, it will be understood from the below description that the ion generator of this disclosure can stably emit electrons with hardly generating discharge products while having a small size. The ion generator hardly generates electromagnetic noise and ozone.

Hereinafter, the charger, the image forming apparatus, the process cartridge, and the ion generator of this disclosure will be described by reference to examples. However, the charger, the image forming apparatus, the process cartridge, and the ion generator of this disclosure are not limited thereto.

Initially, a thin-layer type electron emitter for use in the charger and the ion generator of this disclosure will be described by reference to FIG. 1. FIG. 1 is a schematic view illustrating a thin-layer type electron emitter for use in a charger and an ion generator of this disclosure. Referring to FIG. 1, a thin-layer type electron emitter 10 includes a base electrode 11, and a layer 12 of n-type hexagonal boron nitride codoped with magnesium and oxygen atoms (hereinafter referred to as a Mg—O-codoped n-type hexagonal boron nitride layer 12). In this regard, the base electrode 11 serves as an electroconductive substrate.

The Mg—O-codoped n-type hexagonal boron nitride layer 12 can be funned on the base electrode 11 by a radio frequency (RF) magnetron sputtering method in which a mixture gas of argon and oxygen is used as a discharge gas, and a mixture of a hexagonal boron nitride powder and a magnesium oxide powder is used as a target.

In this regard, the content (O/DG) of oxygen (O) in the discharge gas (DG) (i.e., the molar ratio (O/DG) of oxygen (O) to all of the gases in the discharge gas (DG)) is preferably greater than 0% by mole and less than 2% by mole. When the content is 0% by mole, hexagonal boron nitride cannot be doped with an oxygen atom. In contrast, when the content is not less than 2% by mole, the hexagonal crystal structure of hexagonal boron nitride is destroyed, and thereby a material, which has a structure closer to $B_2O_3$ and which is easily reacted with a water molecule, is formed, resulting in deterioration of resistance to moisture of the layer 12.

The molar ratio (MgO/(BN+MgO)) of magnesium oxide to the total of boron nitride and magnesium oxide is preferably not less than 0.25%. When the molar ratio is less than 0.25%, it is difficult to form n-type hexagonal boron nitride.

The material of the base electrode 11 is not particularly limited as long as the material is electroconductive. Specific examples of the material of the base electrode 11 include metals such as aluminum, nickel, chromium, nichrome, copper, gold, silver and platinum; metal oxides such as tin oxide, indium oxide, zinc oxide, ITO (indium tin oxide), IZO (indium zinc oxide), and GZO (gallium added zinc oxide); and silicon.

Next, a pillar type electron emitter for use in the charger and the ion generator of this disclosure will be described by reference to FIG. 2.

Figure 2:
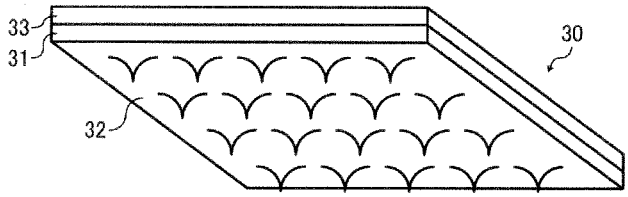
FIG. 2 is a schematic view illustrating a pillar type electron emitter for use in a charger according to an embodiment

FIG. 2 is a schematic view illustrating a pillar type electron emitter for use in a charger and an ion generator of this disclosure. Referring to FIG. 2, a pillar type electron emitter 30 includes a base electrode 33, an electroconductive sheet 31 having projections, and a Mg—O-codoped n-type hexagonal boron nitride layer 32. In this regard, the electroconductive sheet 31 serve as an electroconductive substrate.

The Mg—O-codoped n-type hexagonal boron nitride layer 32 can be formed on the electroconductive sheet 31 having projections by a RF magnetron sputtering method in which a mixture gas of argon and oxygen is used as a discharge gas, and a mixture of a hexagonal boron nitride powder and a magnesium oxide powder is used as a target.

In this regard, the content (O/DG) of oxygen (O) in the discharge gas (DG) is preferably greater than 0% by mole and less than 2% by mole. When the content is 0% by mole, the hexagonal boron nitride cannot be doped with an oxygen atom. In contrast, when the content is not less than 2% by mole, the hexagonal crystal structure of the hexagonal boron nitride is destroyed, and thereby a material, which has a structure closer to $B_2O_3$ and which is easily reacted with a water molecule, is formed, resulting in deterioration of resistance to moisture of the layer 32.

The molar ratio (MgO/(BN+MgO)) of magnesium oxide to the total of boron nitride and magnesium oxide is preferably not less than 0.25%. When the molar ratio is less than 0.25%, it is difficult to form n-type hexagonal boron nitride.

The material of the electroconductive sheet 31 having projections is not particularly limited as long as the material is electroconductive. Specific examples of the material of the electroconductive sheet 31 include metals such as aluminum, nickel, chromium, nichrome, copper, gold, silver and platinum; metal oxides such as tin oxide, indium oxide, zinc oxide, ITO (indium tin oxide), IZO (indium zinc oxide), and GZO (gallium added zinc oxide); and silicon.

An electroconductive sheet, which is prepared by electroforming using a filter of an ejection nozzle, which is disclosed in JP-2000-199469-A, as a mask, can be used as the electroconductive sheet 31 having projections. In this case, metals such as copper, nickel, gold and silver, and metal alloys thereof, which can be easily shaped by electroforming, can be used for the electroconductive sheet 31. The height of the projections and the interval between adjacent projections should be changed depending on the purpose of charging and the applied voltage, but the height is preferably not greater than 50 μm, and the interval is preferably three times the height. The electroconductive sheet having projections will be described later by reference to FIGS. 13A and 13B.

Next, a gate electrode type electron emitter for use in the charger and the ion generator of this disclosure will be described by reference to FIG. 3.

Figure 3:
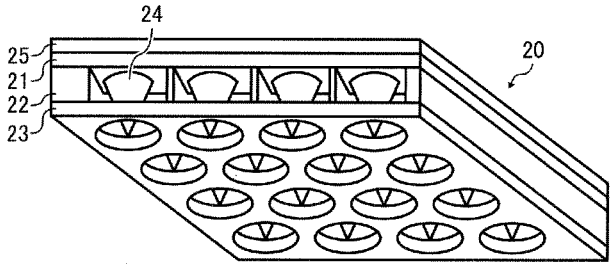
FIG. 3 is a schematic view illustrating a gate electrode type electron emitter for use in a charger according to an embodiment.

FIG. 3 is a schematic view illustrating a gate electrode type electron emitter for use in a charger and an ion generator of this disclosure. Referring to FIG. 3, a gate electrode type electron emitter 20 includes a base electrode 25, an electroconductive sheet 21 having projections, an insulator layer 22, a gate electrode 23, and a Mg—O-codoped n-type hexagonal boron nitride layer 24. In this regard, the electroconductive sheet 21 serve as an electroconductive substrate.

The electroconductive sheet 21 having projections is a substrate having projections thereon, which is formed of an electroconductive material such as metals, e.g., aluminum, nickel, chromium, nichrome, copper, gold, silver and platinum; metal oxides, e.g., tin oxide, indium oxide, zinc oxide, ITO (indium tin oxide), IZO (indium zinc oxide), and GZO (gallium added zinc oxide); and silicon.

An electroconductive sheet, which is prepared by electroforming using a filter of an ejection nozzle, which is disclosed in JP-2000-199469-A, as a mask, can be used as the electroconductive sheet 21 having projections. In this case, metals such as copper, nickel, gold and silver, and metal alloys thereof, which can be easily shaped by electroforming, can be used for the electroconductive sheet 21.

The Mg—O-codoped n-type hexagonal boron nitride layer 24 can be formed on the electroconductive sheet 21 by a RF magnetron sputtering method in which a mixture gas of argon and oxygen is used as a discharge gas, and a mixture of a hexagonal boron nitride powder and a magnesium oxide powder is used as a target.

In this regard, the content (O/DG) of oxygen (O) in the discharge gas (DO) is preferably greater than 0% by mole and less than 2% by mole. When the content is 0% by mole, the hexagonal boron nitride cannot be doped with an oxygen atom. In contrast, when the content is not less than 2% by mole, the hexagonal crystal structure of the hexagonal boron nitride is destroyed, and thereby a material, which has a structure closer to $B_2O_3$ and which is easily reacted with a water molecule, is formed, resulting in deterioration of resistance to moisture of the layer 24.

The molar ratio (MgO/(BN+MgO)) of magnesium oxide to the total of boron nitride and magnesium oxide is preferably not less than 0.25%. When the molar ratio is less than 0.25%, it is difficult to form n-type hexagonal boron nitride.

The material of the insulator layer 22 is not particularly limited as long as the material is an insulating material. Specific examples of such insulating material include mica, silicate glass, silicon oxides, and silicon nitrides.

The material of the gate electrode 23 is not particularly limited as long as the material is an electroconductive material. Specific examples of the electroconductive material include metals such as aluminum, nickel, chromium, nichrome, copper, gold, silver and platinum; metal oxides such as tin oxide, indium oxide, zinc oxide, ITO (indium tin oxide), IZO (indium zinc oxide), and GZO (gallium added zinc oxide); and silicon.

Next, the Mg—O-codoped n-type hexagonal boron nitride will be described. Such Mg—O-codoped n-type hexagonal boron nitride is formed by codoping hexagonal boron nitride with oxygen serving as a donor and magnesium serving as an acceptor. Specific examples thereof include Mg—O-codoped n-type hexagonal boron nitride described by Shinji Ohtani and Kenkichiro Kobayashi in a draft of the 31-st electroceramics workshop, 2P01, published in October 2011; Mg—O-codoped n-type hexagonal boron nitride described by Shinji Ohtani and Kenkichiro Kobayashi in Abstract of International Conference on Electronic and Materials (ICEM) 2012 published in August 2012; and Mg—O-codoped n-type hexagonal boron nitride described by S. Ohtani, T. Yano, S. Kondo, Y. Kohno, Y. Tomita, Y. Maeda and K. Kobayashi in International Union of Materials Research Societys-International Conference in Asia (IUMRS-ICA) 2012, TuP051, published in August 2012.

When a donor (D) impurity or an acceptor (A) impurity is added to a compound, there is a case in which the dopant is not stabilized in the compound if only a donor atom or an acceptor atom is added. In contrast, by using a codoping method in which plural impurities are added to a compound at the same time so that the donor and the acceptor form a complex thereof, the dopant can be stabilized. In this regard, in order that the complex serves as a donor, it is necessary for the complex to have a formula ADx (x>1). In the case of Mg—O-codoped n-type hexagonal boron nitride, n-type hexagonal boron nitride can be prepared by adding an impurity (i.e., negatively charged free electrons are produced in hexagonal boron nitride by adding impurity atoms to pure hexagonal boron nitride). Therefore, oxygen serving as a donor is added at a concentration higher than that of magnesium serving as an acceptor.

Hexagonal boron nitride has good chemical stability (such as heat stability and corrosion resistance). By forming n-type hexagonal boron nitride by performing magnesium and oxygen codoping, the resultant Mg—O-codoped n-type hexagonal boron nitride serves as an electron emitter which can emit an electron at a low electric field while having a good combination of heat resistance and chemical stability that hexagonal boron nitride has.

The reason why the Mg—O-codoped n-type hexagonal boron nitride has a high electron emitting property is not electric field enhancement caused by morphology change of the surface of the thin layer, and is decrease of work function caused by formation of n-type hexagonal boron nitride. Therefore, devices (electron emitters) having the same electron emitting property can be stably produced if the formula of the thin layer is constant.

Further, since a strong local electric field is formed on a tip of a pillar type electron emitter due to electric field enhancement of the projections, emission of electrons can be accelerated, thereby imparting a high efficiency to the electron emitter.

Furthermore, since a gate electrode type electron emitter has a gate electrode, which serves as a counter electrode and which is present in the vicinity of a projection, the local electric field on the tip of the projection can be further increased in addition to the electric field enhancement caused by the projection, thereby imparting a higher efficiency to the electron emitter.

Next, the charger of this disclosure will be described by reference to FIGS. 4, 5 and 6.

Figure 4:
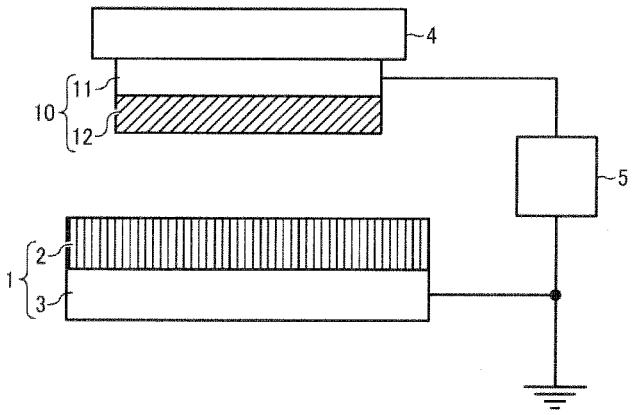
FIG. 4 is a schematic view illustrating a charger according to an embodiment, which uses a thin-layer type electron emitter.

FIG. 4 is a schematic view illustrating a charger, which uses the thin-layer type electron emitter 10 prepared by using a thin layer of Mg—O-codoped n-type hexagonal boron nitride.

Referring to FIG. 4, numerals 1, 2 and 3 denote a photoreceptor, a photosensitive layer, and an electroconductive substrate, and numerals 4 and 5 denote a support, and a power source. In addition, numerals 10, 11 and 12 denote the thin-layer type electron emitter, the base electrode, and the layer of Mg—O-codoped n-type hexagonal boron nitride. In this charger, the thin-layer type electron emitter 10 is arranged so as to be opposed to the photoreceptor 1. When the power source 5 applies a negative voltage to the base electrode 11, the thin-layer type electron emitter 10 emits electrons. The thus emitted electrons are adhered to molecules of gases such as oxygen, carbon dioxide and nitrogen, to which a molecule of water is optionally adhered, resulting in formation of negative ions, thereby negatively charging the photoreceptor 1 with the negative ions.

Figure 5:
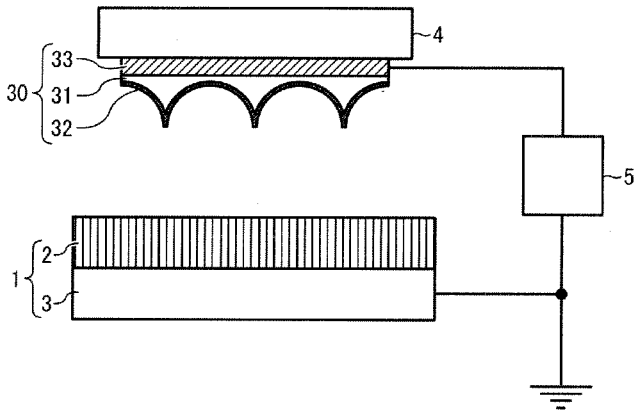
FIG. 5 is a schematic view illustrating a charger according to an embodiment, which uses a pillar type electron emitter.

FIG. 5 is a schematic view illustrating a charger, which uses the pillar type electron emitter 30 prepared by using a thin layer of Mg—O-codoped n-type hexagonal boron nitride.

Referring to FIG. 5, numerals 1, 2 and 3 denote the photoreceptor, the photosensitive layer, and the electroconductive substrate, and numerals 4 and 5 denote the support, and the power source. In addition, numerals 30, 33, 31 and 32 denote the pillar type electron emitter, the base electrode, the electroconductive sheet, and the layer of Mg—O-codoped n-type hexagonal boron nitride. In this charger, the pillar type electron emitter 30 is arranged so as to be opposed to the photoreceptor 1. When the power source 5 applies a negative voltage to the base electrode 33 (i.e., when the power source 5 applies a negative voltage to the electroconductive sheet 31 via the base electrode 33), the pillar type electron emitter 30 emits electrons from the tips of the projections. The thus emitted electrons are adhered to molecules of gases such as oxygen, carbon dioxide and nitrogen, to which a molecule of water is optionally adhered, resulting in formation of negative ions, thereby negatively charging the photoreceptor 1 with the negative ions.

Figure 6:
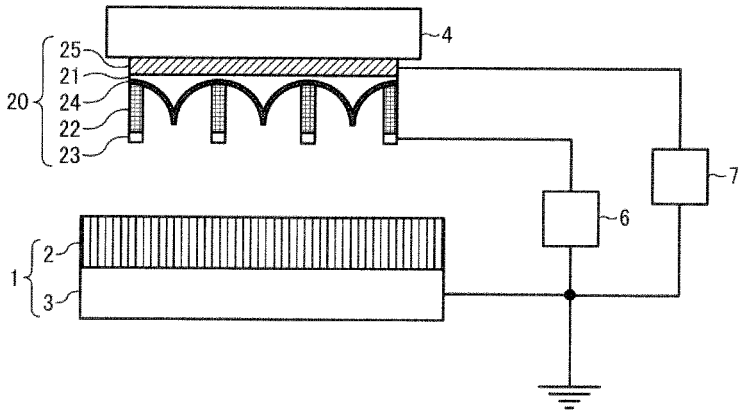
FIG. 6 is a schematic view illustrating a charger according to an embodiment, which uses a gate electrode type electron emitter.

FIG. 6 is a schematic view illustrating a charger, which uses a gate electrode type electron emitter 20 prepared by using a thin layer of Mg—O-codoped n-type hexagonal boron nitride.

Referring to FIG. 6, numerals 1, 2 and 3 denote the photoreceptor, the photosensitive layer, and the electroconductive substrate, and numerals 4, 6 and 7 denote the support, a power source, and another power source. In addition, numerals 20, 25, 21, 22, 23 and 24 denote the gate electrode type electron emitter, the base electrode, the electroconductive sheet having projections, the insulator layer, the gate electrode, and the layer of Mg—O-codoped n-type hexagonal boron nitride. In this charger, the gate electrode type electron emitter 20 is arranged so as to be opposed to the photoreceptor 1. When the power source 7 applies a negative voltage to the electroconductive sheet 21 having projections via the base electrode 25 while the power source 6 applies a negative voltage to the gate electrode 23, the gate electrode type electron emitter 20 emits electrons. The thus emitted electrons are adhered to molecules of gases such as oxygen, carbon dioxide and nitrogen, to which a molecule of water is optionally adhered, resulting in formation of negative ions, thereby negatively charging the photoreceptor 1 with the negative ions.

Next, the reason why the amounts of ozone and NOx can be reduced by using these chargers of this disclosure will be described.

In general, chargers using corona discharge generate large amounts of ozone and NOx. The reason therefor is the following. Specifically, although dissociation energy of a nitrogen molecule caused by electron collision is 24.3 eV and dissociation energy of an oxygen molecule caused by electron collision is 8 eV, energy of electrons emitted by a corona wire is not less than 30 eV. Therefore, molecules of such gasses are dissociated by electron collision.

In contrast, energy of electrons generated by the thin-layer type electron emitter, the pillar type electron emitter, and the gate electrode type electron emitter, which use Mg—O-codoped n-type hexagonal boron nitride, is not greater than 5.2 eV, which is the band gap energy of hexagonal boron nitride. Therefore, the thus emitted electrons do not dissociate molecules of the gasses, thereby not generating ozone and NOx.

Since discharge products such as ozone and NOx are not generated, occurrence of problems in that the discharge products adhere to the surface of a photoreceptor (i.e., an object to be charged); and the surface of the photoreceptor is oxidized or deteriorated by active gasses generated by discharge can be prevented, and in addition deterioration of the electron emitter itself due to combustion caused by oxidation is not caused. Therefore, the charger of this disclosure can stably perform charging over a long period of time.

Next, the image forming apparatus of this disclosure will be described by reference to FIG. 7.

Figure 7:
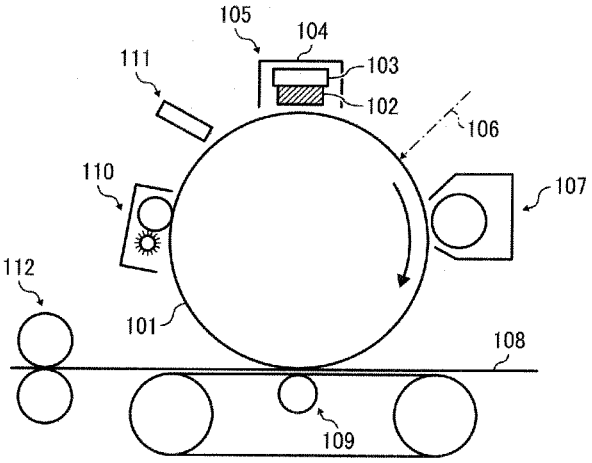
FIG. 7 is a schematic view illustrating an image forming apparatus according to an embodiment.

FIG. 7 is a schematic view illustrating an image forming apparatus according to an embodiment.

Referring to FIG. 7, the image forming apparatus includes a photoreceptor drum 101 rotating in a direction indicated by an arrow, and a charger 105, which charges the peripheral surface of the photoreceptor drum 101 and which includes an electron emitter 102 which is the thin-layer type electron emitter, the pillar type electron emitter, or the gate electrode type electron emitter mentioned above, and a case 104. In addition, a developing device 107 to develop an electrostatic latent image, which is formed on the photoreceptor drum 101 by laser light 106 emitted by an irradiator according to image data of an original image, with toner to form a toner image; a transferring device 109 to transfer the toner image on the photoreceptor drum 101 to a recording medium 108; a cleaner 110 to remove residual toner from the surface of the photoreceptor drum 101; and a discharger 111 to remove residual charges from the photoreceptor drum 101 are arranged around the photoreceptor drum 101. Further, the image forming apparatus includes a fixing device 112 to fix the toner image to the recording medium 108. Numeral 103 in FIG. 7 denotes a support of the electron emitter 102.

When a charger using the above-mentioned thin-layer type electron emitter is used for the charger 105 while forming a gap of from 0 to 200 μm between the surface of the thin-layer type electron emitter 102 and the surface of the photoreceptor drum 101 and applying a negative voltage to the base electrode (i.e., the base electrode 11 illustrated in FIG. 1) of the thin-layer type electron emitter 102, electrons emitted by the electron emitter 102 are adhered to the surface of the photoreceptor drum 101, thereby charging the surface of the photoreceptor drum.

When a charger using the above-mentioned pillar type electron emitter is used for the charger 105 while forming a gap of from 0 to 200 μm between the pillar type electron emitter 102 and the surface of the photoreceptor drum 101 and applying a negative voltage to the base electrode (i.e., the base electrode 33 illustrated in FIG. 2) of the pillar type electron emitter 102, electrons emitted by the electron emitter 102 are adhered to the surface of the photoreceptor drum 101, thereby charging the surface of the photoreceptor drum.

When a charger using the above-mentioned gate electrode type electron emitter is used for the charger 105 while forming a gap of from 0 to 200 μm between the gate electrode type electron emitter 102 and the surface of the photoreceptor drum 101 and applying a negative voltage to the base electrode (i.e., the base electrode 25 illustrated in FIG. 3) of the gate electrode type electron emitter 102, electrons emitted by the electron emitter 102 are adhered to the surface of the photoreceptor drum 101, thereby charging the surface of the photoreceptor drum.

After the photoreceptor drum 101 is charged by the charger 105, the photoreceptor drum continues to rotate (for example, at a speed of 200 mm/s) while being exposed to the laser light 106 emitted by an irradiator, thereby forming an electrostatic latent image on the photoreceptor drum. The electrostatic latent image is developed by the developing device 107 using a developer (such as toner), thereby forming a visible image (a toner image) on the surface of the photoreceptor drum 101. The toner image on the photoreceptor drum 101 is then transferred to the recording medium 108 such as paper sheets by the transferring device 109. Even after the toner image is transferred, a small amount of toner remains on the surface of the photoreceptor drum 101, and therefore the cleaner 110 removes the residual toner from the surface of the photoreceptor drum 101. Next, the discharger 111 discharges the photoreceptor drum 101, if desired, so that the photoreceptor drum is ready for the next image forming process.

The image forming apparatus does not necessarily perform the cleaning process, and a cleaner-less process can be used for the image forming apparatus. In this case, the residual toner on the photoreceptor drum 101 is collected by the developing device to be reused for development.

The charger of this disclosure, which includes the thin-layer type electron emitter, the pillar type electron emitter, or the gate electrode type electron emitter 102, can charge the photoreceptor drum 101 serving as an image carrier without generating ozone and NOx. In addition, in the charger, the applied voltage can be reduced so as to be lower than that in conventional corona charging or charging using a roller. Therefore, the image forming apparatus can save energy. Further, since electrons can be emitted by a low energy, occurrence of a problem in that organic materials (such as polycarbonate) constituting the photoreceptor drum 101 are oxidized (combusted) can be prevented, thereby decreasing the abrasion loss of the photosensitive layer of the photoreceptor drum 101.

Next, the process cartridge of this disclosure, which uses the charger of this disclosure, will be described by reference to FIG. 8.

Figure 8:
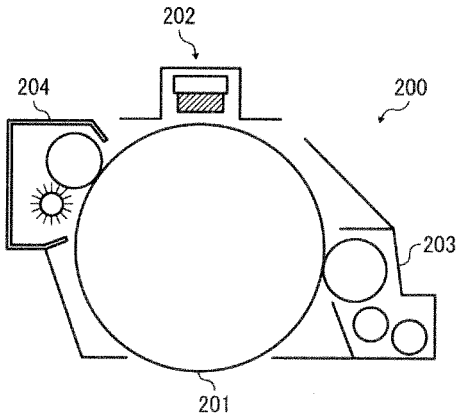
FIG. 8 is a schematic view illustrating a process cartridge according to an embodiment.

Referring to FIG. 8, a process cartridge 200 includes an image carrier 201 (such as a photoreceptor drum) to bear an electrostatic latent image thereon; a charger 202, which is the charger of this disclosure and which charges the peripheral surface of the image carrier 201; a developing device 203 to develop the electrostatic latent image on the image carrier 201 with a developer (such as toner) to form a visible image (such as a toner image) on the image carrier; and a cleaner 204 to clean the peripheral surface of the image carrier 101, wherein these devices are integrated as a single unit (i.e., a process cartridge) so as to be detachably attachable to the main body of an image forming apparatus such as copiers and printers. However, the process cartridge of this disclosure is not limited thereto. The process cartridge of this disclosure includes the charger of this disclosure, and at least one of an image carrier (such as the image carrier 201), a developing device (such as the developing device 203), and a cleaner (such as the cleaner 204).

When the charger of this disclosure is provided in the process cartridge, which is detachably attachable to the main body of an image forming apparatus, maintenance of the charger, the process cartridge and the image forming apparatus can be easily performed. In addition, replacement of a device in the process cartridge can be easily performed by replacing the process cartridge with a new process cartridge.

Next, another image forming apparatus (a color image forming apparatus) of this disclosure, which uses the charger of this disclosure or the process cartridge of this disclosure, will be described by reference to FIG. 9.

Figure 9:
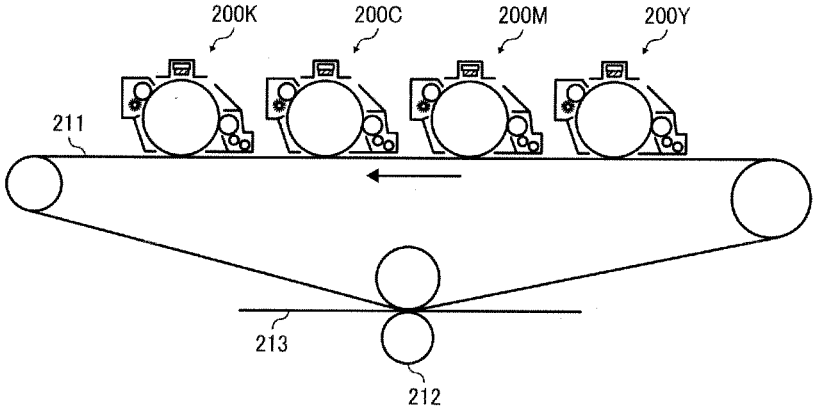
FIG. 9 is a schematic view illustrating an image forming apparatus according to an embodiment, which uses the process cartridge illustrated in FIG. 8.

A color image forming apparatus illustrated in FIG. 9 includes a transfer belt 211, which serves as an image carrier and which extends in the horizontal direction while being rotated in a direction indicated by an arrow; and four process cartridges 200Y, 200M, 200C and 200K, which are arranged side by side along the transfer belt 211 and which are the process cartridge 200 mentioned above to form yellow (Y), magenta (M), cyan (C) and black (K) toner images, respectively, on the image carriers 201 thereof (i.e., the reference number 201 is not illustrated in FIG. 9 but is illustrated in FIG. 8). The Y, M, C and K toner images formed on the image carriers 201 are sequentially transferred to the transfer belt 211, to which a transfer voltage is applied, thereby forming a combined color toner image, in which the Y, M, C and K toner images are overlaid, on the transfer belt 211. The combined color toner image on the transfer belt 211 is then transferred to a recording medium 213 by a secondary transferring device 212. The combined color toner image on the recording medium 213 is then fixed to the recording medium by a fixing device (not shown in FIG. 9). The positional order of the four process cartridges 200 is not particularly limited, and any positional order is available.

In general, color image forming apparatus have a large size because of having plural image forming sections. In addition, when a device such as cleaners and chargers is damaged or the life of a device expires, it takes time to replace the device with a new device because such color image forming apparatus have a complex structure. In contrast, in the color image forming apparatus of this disclosure, devices such as the image carrier, the charger of this disclosure, the developing device, and the cleaner are integrated as a single unit (process cartridge). Therefore, the color image forming apparatus of this disclosure has a relatively small size while having good durability, and has an advantage such that replacement of the devices can be easily performed by a user.

Next, the ion generator of this disclosure will be described by reference to FIGS. 10-12.

Figure 10:
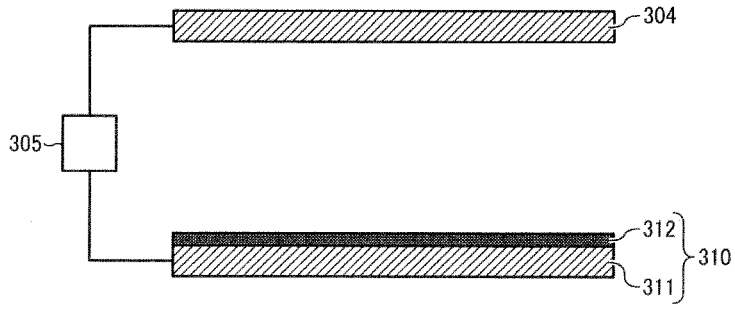
FIG. 10 is a schematic view illustrating an ion generator according to an embodiment, which uses a thin-layer type electron emitter.

FIG. 10 is a schematic view illustrating an example of the ion generator of this disclosure, which uses a thin-layer type electron emitter. In the ion generator illustrated in FIG. 10, numerals 310, 311, 312, 304 and 305 respectively denote a thin-layer type electron emitter, a base electrode, a thin layer of Mg—O-codoped n-type hexagonal boron nitride, a counter electrode, and a power source. The thin-layer type electron emitter 310 is arranged so as to be opposed to the counter electrode 304 with a small gap therebetween. The counter electrode 304 is grounded. The base electrode 311 serves as an electroconductive substrate. When the power source 305 applies a negative voltage to the base electrode 311 of the thin-layer type electron emitter 310, the thin layer of Mg—O-codoped n-type hexagonal boron nitride 312 emits electrons. The thus emitted electrons collide against molecules of water in the air, thereby generating positive ions and negative ions.

Figure 11:
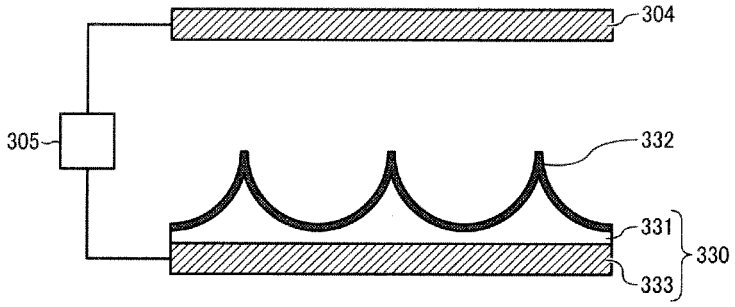
FIG. 11 is a schematic view illustrating an ion generator according to an embodiment, which uses a pillar type electron emitter.

FIG. 11 is a schematic view illustrating another example of the ion generator of this disclosure, which uses a pillar type electron emitter. In the ion generator illustrated in FIG. 11, numerals 330, 333, 331, 332, 304 and 305 respectively denote a pillar type electron emitter, a base electrode, an electroconductive sheet having projections, a thin layer of Mg—O-codoped n-type hexagonal boron nitride, a counter electrode, and a power source. The pillar type electron emitter 330 is arranged so as to be opposed to the counter electrode 304 with a small gap therebetween. The counter electrode 304 is grounded. The electroconductive sheet 331 having projections serve as an electroconductive substrate. When the power source 305 applies a negative voltage to the electroconductive sheet 331 via the base electrode 333 of the pillar type electron emitter 330, the surface of the thin layer of Mg—O-codoped n-type hexagonal boron nitride 332 on the tip of projections of the electroconductive substrate 331 emits electrons. The thus emitted electrons collide against molecules of water in the air, thereby generating positive ions and negative ions.

Figure 12:
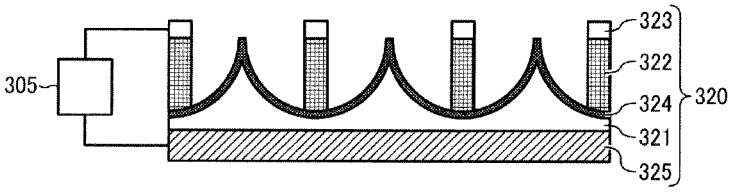
FIG. 12 is a schematic view illustrating an ion generator according to an embodiment, which uses a gate electrode type electron emitter.

FIG. 12 is a schematic view illustrating another example of the ion generator of this disclosure, which uses a gate electrode type electron emitter. In the ion generator illustrated in FIG. 12, numerals 320, 325, 321, 324, 322, 323 and 305 respectively denote a gate electrode type electron emitter, a base electrode, an electroconductive sheet having projections, a thin layer of Mg—O-codoped n-type hexagonal boron nitride, an insulator layer, a gate electrode, and a power source. The electroconductive sheet 321 having projections serve as an electroconductive substrate. When a voltage is placed between the base electrode 325 (i.e., the electroconductive sheet 321 via the base electrode 325) of the gate electrode type electron emitter 320 and the gate electrode 323 by the power source 305, the surface of the thin layer of Mg—O-codoped n-type hexagonal boron nitride 324 on the tip of projections of the electroconductive sheet 321 emits electrons. The thus emitted electrons collide against molecules of water in the air, thereby generating positive ions and negative ions.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1 of Electron Emitter

A thin-layer type electron emitter was prepared by forming a thin layer of Mg—O-codoped n-type hexagonal boron nitride on a n-silicon substrate using a radio frequency (RF) magnetron sputtering method. In this regard, a mixture of argon and oxygen was used as the discharge gas, and a mixture of a hexagonal boron nitride powder and a magnesium oxide powder was used as the target. The content of oxygen in the discharge gas was 1% by mole. In addition, the molar ratio (MgO/(BN+MgO)) of magnesium oxide to the total of boron nitride and magnesium oxide is 0.25%.

Thus, a thin-layer type electron emitter of Example 1 was prepared.

Comparative Example 1 of Electron Emitter

The procedure for preparation of the thin-layer type electron emitter of Example 1 was repeated except that only the hexagonal boron nitride powder was used as the target. Thus, a thin-layer type electron emitter of Comparative Example 1 was prepared.

Preparation of Electroconductive Sheet Having Projections

An electroconductive sheet, which was prepared by electroforming using a filter of an ejection nozzle, which is disclosed in JP-2000-199469-A, as a mask, was used as the electroconductive sheet having projections. In this case, nickel was used as the material constituting the electroconductive sheet.

Figure 13A:
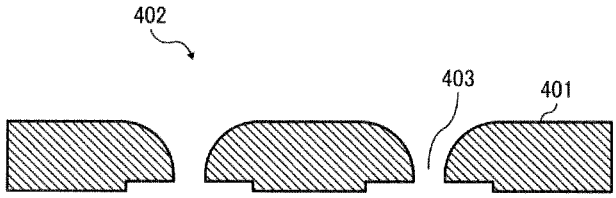
FIGS. 13A and 13B are schematic cross-sectional and plan views illustrating a filter for use in preparing an electroconductive sheet having projections.
Figure 13B:
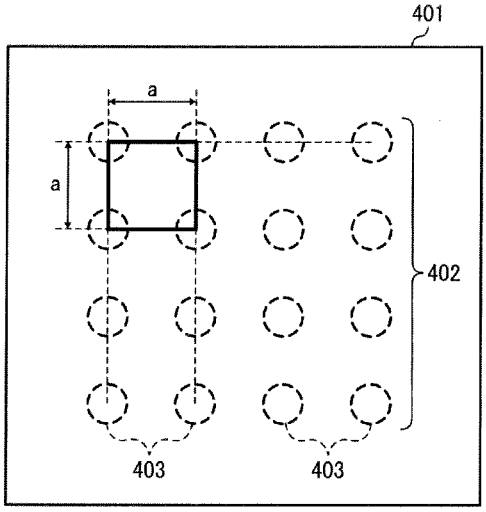

The filter used is a filter 401 illustrated in FIGS. 13A and 13B. Specifically, as illustrated in FIGS. 13A and 13B, the filter 401 has a group 402 of chamfered through-holes 403, which have a curvature of about 20 μm and which are arranged like a square lattice having intervals (a) of 50 μm.

Example 2 of Electron Emitter

A pillar type electron emitter was prepared by forming a thin layer of Mg—O-codoped n-type hexagonal boron nitride on the above-prepared electroconductive nickel sheet having projections using a radio frequency (RF) magnetron sputtering method. In this regard, the thickness of the electroconductive nickel sheet having projections was 30 μm, the height of the projections was 20 μm, and the interval between the projections was 50 μm. In addition, a mixture of argon and oxygen was used as the discharge gas, and a mixture of a hexagonal boron nitride powder and a magnesium oxide powder was used as the target. The content of oxygen in the discharge gas was 1% by mole. In addition, the molar ratio (MgO/(BN+MgO)) of magnesium oxide to the total of boron nitride and magnesium oxide is 0.25%.

Thus, a pillar type electron emitter of Example 2 was prepared.

Comparative Example 2 of Electron Emitter

The procedure for preparation of the pillar type electron emitter of Example 2 was repeated except that only the hexagonal boron nitride powder was used as the target. Thus, a pillar type emitter of Comparative Example 2 was prepared.

Example 3 of Electron Emitter

A gate electrode type electron emitter was prepared by forming a thin layer of Mg—O-codoped n-type hexagonal boron nitride on the above-prepared electroconductive nickel sheet having projections using a radio frequency (RF) magnetron sputtering method. In addition, an insulator layer of mica having a thickness of 100 μm was formed on the thin layer of Mg—O-codoped n-type hexagonal boron nitride. Further, a gate electrode of Au having a thickness of 15 nm was formed on the insulator layer. In this regard, the thickness of the electroconductive nickel sheet having projections was 30 μm, the height of the projections was 20 μm, and the interval between the projections was 50 μm. In addition, a mixture of argon and oxygen was used as the discharge gas, and a mixture of a hexagonal boron nitride powder and a magnesium oxide powder was used as the target. The content of oxygen in the discharge gas was 1% by mole. In addition, the molar ratio (MgO/(BN+MgO)) of magnesium oxide to the total of boron nitride and magnesium oxide is 0.25%.

Thus, a gate electrode type electron emitter of Example 3 was prepared.

Comparative Example 3 of Electron Emitter

The procedure for preparation of the gate electrode type electron emitter of Example 3 was repeated except that only the hexagonal boron nitride powder was used as the target. Thus, a gate electrode type electron emitter of Comparative Example 3 was prepared.

Example 1

A charger having such a configuration as illustrated in FIG. 4 was prepared using the thin layer type electron emitter of Example 1.

Comparative Example 1

A charger having such a configuration as illustrated in FIG. 4 was prepared using the thin layer type electron emitter of Comparative Example 1.

Example 2

A charger having such a configuration as illustrated in FIG. 5 was prepared using the pillar type electron emitter of Example 2.

Comparative Example 2

A charger having such a configuration as illustrated in FIG. 5 was prepared using the pillar type electron emitter of Comparative Example 2.

Example 3

A charger having such a configuration as illustrated in FIG. 6 was prepared using the gate electrode electron emitter of Example 3.

Comparative Example 3

A charger having such a configuration as illustrated in FIG. 6 was prepared using the gate electrode electron emitter of Comparative Example 3.

The chargers of Examples 1-3 and Comparative Examples 1-3 were evaluated as follows.

1. Electron Emitting Property

Each of the chargers was set in an image forming apparatus in such a manner that the gap between the charger and an image carrier (i.e., the photoreceptor 1 illustrated in FIGS. 4, 5 and 6) is 200 μm to charge the image carrier, which is rotated at a linear speed of 200 mm/sec, and a voltage was applied to the charger as mentioned below while measuring the surface potential of the image carrier.

In this regard, in each of the chargers of Example 1 and Comparative Example 1, a voltage of −400V was applied to the base electrode of the thin-layer type electron emitter.

In each of the chargers of Example 2 and Comparative Example 2, a voltage of −400V was applied to the base electrode of the pillar type electron emitter.

In each of the chargers of Example 3 and Comparative Example 3, a voltage of −400V was applied to the base electrode of the gate electrode type electron emitter, and a voltage of −15V was applied to the gate electrode.

The surface potential of the image carrier is shown in Table 1 below.

TABLE 1

| | Ex. 1 | Comp. Ex. 1 | Ex. 2 | Comp. Ex. 2 | Ex. 3 | Comp. Ex. 3 |
|---|---|---|---|---|---|---|
| Surface potential (V) | −292 | −0.2 | −351 | −10.2 | −611 | −106.2 |

It can be confirmed from Table 1 that chargers of this disclosure using the thin-layer type electron emitter, the pillar type electron emitter, or the gate electrode type electron emitter, which uses a thin layer of Mg—O-codoped n-type hexagonal boron nitride, can charge an image carrier at a relatively low applied voltage compared to those of conventional corona chargers and comparative chargers using a thin-layer type electron emitter, a pillar type electron emitter, or a gate electrode type electron emitter, which uses a thin layer of non-doped hexagonal boron nitride.

Example 1'

An ion generator having such a configuration as illustrated in FIG. 10 was prepared using the thin layer type electron emitter of Example 1.

Comparative Example 1'

An ion generator having such a configuration as illustrated in FIG. 10 was prepared using the thin layer type electron emitter of Comparative Example 1.

Example 2'

An ion generator having such a configuration as illustrated in FIG. 11 was prepared using the pillar type electron emitter of Example 2.

Comparative Example 2'

An ion generator having such a configuration as illustrated in FIG. 11 was prepared using the pillar type electron emitter of Comparative Example 2.

Example 3'

An ion generator having such a configuration as illustrated in FIG. 12 was prepared using the gate electrode type electron emitter of Example 3.

Comparative Example 3'

An ion generator having such a configuration as illustrated in FIG. 12 was prepared using the gate electrode type electron emitter of Comparative Example 3.

The ion generators of Examples 1'-3' and Comparative Examples 1'-3' were evaluated as follows.

1. Amount of Ions Generated by Ion Generator

The amount of ions generated by each of the ion generators for 10 seconds was measured using a Faraday cup (Model 284 NanoCoulomb Meter from Monroe Electronics).

In this regard, in each of the ion generators of Example 1' and Comparative Example a voltage of −400V was applied to the base electrode of the electron emitter.

In each of the ion generators of Example 2' and Comparative Example 2', a voltage of −400V was applied to the base electrode of the electron emitter.

In each of the chargers of Example 3' and Comparative Example 3', a voltage of −400V was applied to the base electrode of the gate electrode type electron emitter, and no voltage was applied to the gate electrode (i.e., the gate electrode had a potential of 0V).

The amount of ions generated is shown in Table 2 below.

TABLE 2

| | Ex. 1' | Comp. Ex. 1' | Ex. 2' | Comp. Ex. 2' | Ex. 3' | Comp. Ex. 3' |
|---|---|---|---|---|---|---|
| Amount of ions generated (nC) | 11.5 | 0.0 | 24.0 | 10.0 | 35.2 | 12.0 |

It can be confirmed from Table 2 that ion generators of this disclosure using the thin-layer type electron emitter, the pillar type electron emitter, or the gate electrode type electron emitter, which uses a thin layer of Mg—O-codoped n-type hexagonal boron nitride, can generate ions at a relatively low applied voltage compared to those of comparative ion generators using a thin-layer type electron emitter, a pillar type electron emitter, or a gate electrode type electron emitter, which uses a thin layer of non-doped hexagonal boron nitride.

As mentioned above, the charger, the process cartridge, and the image forming apparatus of this disclosure can emit electrons without generating discharge products. Therefore, the image carrier of the process cartridge and the image forming apparatus is hardly exposed to hazards. In addition, since the electron emitter itself is hardly deteriorated, the quality of the electron emitter can be stabilized.

Further, the ion generator of this disclosure can emit electrons at a low applied voltage without generating discharge products while having a small size. In addition, the ion generator can prevent generation of electromagnetic noise and ozone.

Additional modifications and variations of the present invention are possible in light of the above teachings. It is therefore to be understood that within the scope of the appended claims the invention may be practiced other than as specifically described herein.

What is claimed is:

1. A charger to apply a charge to an object, comprising:
an electron emitter including:
an electroconductive substrate; and
a layer of n-type hexagonal boron nitride codoped with magnesium and oxygen atoms, which is located on the electroconductive substrate,
wherein a concentration of oxygen atoms in the layer of n-type hexagonal boron nitride codoped with magnesium and oxygen atoms is higher than a concentration of magnesium atoms in the layer,
wherein the layer of n-type hexagonal boron nitride codoped with magnesium and oxygen atoms is located on a surface of the electroconductive substrate while having projections, and
wherein the electron emitter further includes:
an insulator layer located on a surface of the layer of n-type hexagonal boron nitride codoped with magnesium and oxygen atoms in such a manner as to surround the projections of the layer of n-type hexagonal boron nitride codoped with magnesium and oxygen atoms; and
a gate electrode located on the insulator layer.

2. The charger according to claim 1, wherein the electroconductive substrate has projections on the surface thereof.

3. The charger according to claim 1, further comprising:
a support to support the electron emitter; and
a power source to apply a voltage to the electroconductive substrate of the electron emitter.

4. An image forming apparatus comprising:
an image carrier to bear an electrostatic latent image on a surface thereof;
the charger according to claim 1 to charge the image carrier to form the electrostatic latent image; and
a developing device to visualize the electrostatic latent image using a colored material.

5. A process cartridge comprising:
the charger according to claim 1 to charge an image carrier to form an electrostatic latent image on a surface of the image carrier; and
at least one of the image carrier, a developing device to visualize the electrostatic latent image using a colored material, and a cleaner to clean the surface of the image carrier,
wherein the charger and at least one of the image carrier, the developing device, and the cleaner are integrated as a single unit so as to be detachably attachable to an image forming apparatus.

6. A color image forming apparatus comprising:
at least two image earners, each of which bears an electrostatic latent image on a surface thereof;
at least two chargers to charge the at least two image carriers to form the electrostatic latent images on surfaces of the image carriers, wherein each of the at least two chargers is the charger according to claim 1;
at least two developing devices to visualize the electrostatic latent images on the image carriers using different colored materials; and
at least two cleaners to clean the surfaces of the image carriers,
wherein one of the at least two chargers, and at least one of the at least two image carriers, one of the at least two developing devices, and one of the at least two cleaners are integrated as a process cartridge, and wherein the image forming apparatus includes two or more process cartridges.

7. A charger to apply a charge to an object, comprising:
an electron emitter including:
an electroconductive substrate; and
a layer of n-type hexagonal boron nitride codoped with magnesium and oxygen atoms, which is located on the electroconductive substrate,
wherein a concentration of oxygen atoms in the layer of n-type hexagonal boron nitride codoped with magnesium and oxygen atoms is higher than a concentration of magnesium atoms in the layer,
wherein the electroconductive substrate has projections on a surface thereof, and the layer of n-type hexagonal boron nitride codoped with magnesium and oxygen atoms is located on the surface of the electroconductive substrate while having projections, and
wherein the electron emitter further includes:
an insulator layer located on a surface of the layer of n-type hexagonal boron nitride codoped with magnesium and oxygen atoms in such a manner as to surround the projections of the layer of n-type hexagonal boron nitride codoped with magnesium and oxygen atoms; and a gate electrode located on the insulator layer.

8. The charger according to claim 7, further comprising:

a support to support the electron emitter; and a power source to apply a voltage to each of the electroconductive substrate and the gate electrode of the electron emitter.

9. An image forming apparatus comprising:

an image carrier to bear an electrostatic latent image on a surface thereof;

the charger according to claim 7 to charge the image carrier to form the electrostatic latent image; and a developing device to visualize the electrostatic latent image using a colored material.

10. A process cartridge comprising:

the charger according to claim 7 to charge an image carrier to form an electrostatic latent image on a surface of the image carrier; and at least one of the image carrier, a developing device to visualize the electrostatic latent image using a colored material, and a cleaner to clean the surface of the image carrier, wherein the charger and at least one of the image carrier, the developing device, and the cleaner are integrated as a single unit so as to be detachably attachable to an image forming apparatus.

11. A color image forming apparatus comprising:

at least two image carriers, each of which bears an electrostatic latent image on a surface thereof;

at least two chargers to charge the at least two image carriers to form the electrostatic latent images on surfaces of the image carriers, wherein each of the at least two chargers is the charger according to claim 7;

at least two developing devices to visualize the electrostatic latent images on the image carriers using different colored materials; and at least two cleaners to clean the surfaces of the image carriers, wherein one of the at least two chargers, and at least one of the at least two image carriers, one of the at least two developing devices, and one of the at least two cleaners are integrated as a process cartridge, and wherein the image forming apparatus includes two or more process cartridges.

12. An ion generator to generate an ion by bombarding a water molecule in air with an electron, comprising:

an electron emitter including;

an electroconductive substrate; and a layer of n-type hexagonal boron nitride codoped with magnesium and oxygen atoms, which is located on the electroconductive substrate, wherein a concentration of oxygen atoms in the layer of n-type hexagonal boron nitride codoped with magnesium and oxygen atoms is higher than a concentration of magnesium atoms in the layer, wherein the layer of n-type hexagonal boron nitride codoped with magnesium and oxygen atoms is located on a surface of the electroconductive substrate while having projections, and wherein the electron emitter further includes:

an insulator layer located on a surface of the layer of n-type hexagonal boron nitride codoped with magnesium and oxygen atoms in such a manner as to surround the projections of the layer of n-type hexagonal boron nitride codoped with magnesium and oxygen atoms; and a gate electrode located on the insulator layer.

13. An ion generator according to claim 12, wherein the electroconductive substrate has projections on the surface thereof.

14. The ion generator according to claim 12, further comprising:

a power source to apply a voltage to each of the electroconductive substrate and the gate electrode of the electron emitter.

* * * * *